US008769735B2

(12) United States Patent
Cen

(10) Patent No.: US 8,769,735 B2
(45) **Date of Patent: *Jul. 8, 2014**

(54) DRAINAGE DEVICE FOR KITCHEN AND BATH FACILITIES

(75) Inventor: Difeng Cen, Ningbo (CN)

(73) Assignee: Ningbo Bosheng Plumbing Co., Ltd., Ningbo, Zhejiang Province (CN)

( * ) Notice: Subject to any disclaimer, the term of this patent is extended or adjusted under 35 U.S.C. 154(b) by 376 days.

This patent is subject to a terminal disclaimer.

(21) Appl. No.: 13/144,268

(22) PCT Filed: Dec. 31, 2009

(86) PCT No.: PCT/CN2009/076387

§ 371 (c)(1), (2), (4) Date: Jul. 12, 2011

(87) PCT Pub. No.: WO2010/083719

PCT Pub. Date: Jul. 29, 2010

(65) Prior Publication Data

US 2011/0271442 A1 Nov. 10, 2011

(30) Foreign Application Priority Data

Jan. 20, 2009 (CN) ..... 2009 2 0113127
Jan. 23, 2009 (CN) ..... 2009 1 0095599

(51) Int. Cl.
*E03C 1/23* (2006.01)

(52) U.S. Cl.
USPC ..... 4/691

(58) Field of Classification Search
USPC ..... 4/688–693, 293, 295
See application file for complete search history.

(56) References Cited

U.S. PATENT DOCUMENTS 1,710,289 A * 4/1929 Bresler ..... 4/690
2,137,496 A * 11/1938 Klein ..... 4/689

* cited by examiner

*Primary Examiner* — Gregory Huson
*Assistant Examiner* — Janie Christiansen

(57) ABSTRACT

A drainage device for kitchen and bath facilities includes a downspout body (B1) and a pipe cover (B2). The downspout body (B1) is provided with a rotatable linkage unit capable of bending and stretching in vertical direction and a guide unit for guiding vertical movement. The pipe cover (B2) is connected with the upper end of the linkage unit, a coupling member is led out from the side wall of the downspout body (B1), one end of the coupling member is connected with the linkage unit and the other end is connected with an operating mechanism (A).

5 Claims, 10 Drawing Sheets

DRAINAGE DEVICE FOR KITCHEN AND BATH FACILITIES

BACKGROUND OF THE PRESENT INVENTION

1. Field of Invention

The present invention relates to a drainage device for kitchen and bath facilities.

2. Description of Related Arts

At present, there are two main kinds of drainage device for being applied to a basin in kitchen or bathroom. One is a traditional lifting type, in which the lifting part is installed on the back of the faucet. This drainage device is easy to be destroyed and is inconvenient to operate. The other drainage device provides an open-and-close member directly plugged into the outlet of the basin. This method is easy to operate and not easy to be destroyed. But its disadvantage is that during the opening and closing operation, a user has to contact with the used water in the basin.

SUMMARY OF THE PRESENT INVENTION

An object of the present invention is to provide a drainage device for kitchen and bath facilities which has the advantage of easy operation, good sealing effect and in line with user-friendly design.

Accordingly, in order to accomplish the above object, the present invention provides a drainage device comprising a drainage mechanism and an operating mechanism. The drainage mechanism comprises a downspout body and a pipe cover, wherein the downspout body is provided with a rotatable linkage unit which is capable of bending and stretching in vertical direction and a guide unit for guiding vertical movement. The pipe cover is connected with an upper portion of the linkage unit, and a coupling member is led out from the sidewall of the downspout body, wherein one end of the coupling member is connected with the linkage unit, and the other end of the coupling member is connected with the operating mechanism which is adapted to operate the linkage unit. Due to above structure, the present invention has two operating methods. One is to use the operating mechanism to operate linkage unit to switch drainage and storage. The other is to directly operate the pipe cover to switch two states. Both methods provide convenient operation for user, and have good sealing effect.

These and other objectives, features, and advantages of the present invention will become apparent from the following detailed description, the accompanying drawings, and the appended claims.

DETAILED DESCRIPTION OF THE PREFERRED EMBODIMENT

Figure 1:
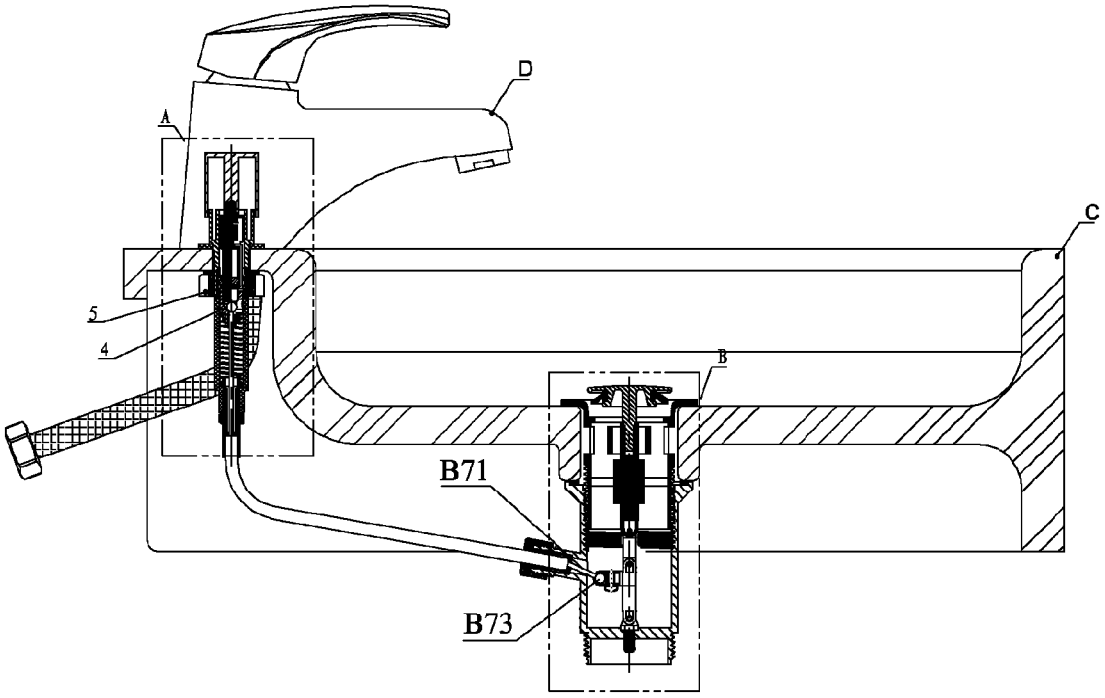
FIG. 1 is a sectional view taken along the line M-M shown in FIG. 5, illustrating drainage state of a drainage device applied to a sink according to a first embodiment of the present invention.

Referring to FIG. 1 to FIG. 7 of the drawings, a first embodiment of a drainage device is illustrated, in which the drainage device is applied to a sink C.

The drainage device comprises a drainage mechanism B and an operating mechanism A. The drainage mechanism B is placed on a lower outlet of the sink C.

The drainage mechanism B comprises a downspout body B1 and a pipe cover B2, wherein the downspout body B1 is provided with a rotatable linkage unit which is capable of bending and stretching in vertical direction and a guide unit for guiding vertical movement.

According to the first embodiment, the downspout body B1 comprises an upper pipe B11 and a lower pipe B12, wherein the upper pipe B11 is threaded engaged with the lower pipe B12. The guide unit is located in the upper pipe B11, and the linkage unit is located in the lower pipe B12, so as to facilitate manufacture and installation.

The guide unit comprises a guide pipe B4, wherein the guide pipe B4 is connected with the upper portion of the downspout body B1 via a first frame B41, that is, according to the first embodiment, the guide pipe B4 is connected with the upper pipe B11 of the downspout body B1.

A coupling member is led out from the sidewall of the downspout body B1, wherein one end of the coupling member is connected with the linkage unit, and the other end of the coupling member is connected with the operating mechanism A which is adapted to operate the linkage unit. The linkage unit comprises a lower rocking rod B62, a middle linking rod B61 hingedly connected with the lower rocking rod B62, and a lifting rod B3 guided by the guide unit. The lifting rod B3 passes through the guide pipe B4 so as to be guide by the guide pipe B4. The pipe cover B2 is connected with the lifting rod B3, and the coupling member is connected with the lower rocking rod B62. According to the first embodiment, the lower portion of the downspout body B1, specifically, a second frame B63 is provided in the lower pipe B12 of the downspout body B1, and the lower end of the lower rocking rod B62 is hingedly connected with the second frame B63.

The coupling member comprises a coupling wire B71 made of steel and a coupling base B72, wherein the coupling base B72 is connected with the lower rocking rod B62, so as to facilitate the coupling member to take a push-pull effect on the linkage unit. A first coupling ball B73 is provided on one end of the coupling wire B71, and rotatably stuck in the coupling base B72. A block B74 is connected with the coupling base B72 and matched with the coupling ball B73 for pushing and resisting the first coupling ball B73.

The operating mechanism A comprises a sliding shaft 2 having a head 21 and a tail 24, a fixing casing 1 with a hollow structure, wherein the sliding shaft 2 is slidably located in the fixing casing 1 and connected with the coupling wire B71. The operating mechanism A further comprises a spring 3 at a position to resist the sliding shaft 2 from head 21 to tail 24. Preferably, along the direction of the spring resisting up, there are a first position 71 and a second position 72 provided for being capable of keeping the sliding shaft 2 stopping at different heights.

The head 21 of the sliding shaft 2 is threaded engaged with a nut 4, and a second coupling ball B75 is provided on the other end of the coupling wire B71 and stuck in the nut 4.

According to the first embodiment, the operating mechanism A is mounted on the sink C or a platform for supporting the sink C at a position beside the faucet D. The outer wall of the fixing casing 1 is step-shaped, and the fixing casing 1 is stuck and then fixed on the sink C or the platform by a fixing nut 5. The other opponents of the operating mechanism A are all supported by the fixing casing 1.

The operating mechanism A further comprises a button 23 connected with the tail 24 of the sliding shaft 2.

A spring cover 6 is connected with the lower end of the fixing casing 1, wherein the spring 3 is mounted in the spring cover 6 to resist up the sliding shaft 2.

According to the first embodiment, the fixing casing 1 comprises a casing plug 7 threaded engaged with the fixing casing 1, wherein the sliding shaft 2 is passed through the casing plug 7. The sliding shaft 2 has a positioning slot 22 along axial direction and matched with the casing plug 7 to position the sliding shaft 2 in circumferential direction.

The operating mechanism A further comprises a stop hook 8 having a hook member and a connecting member hooked the casing plug 7, in such a manner that the casing plug 7 is capable of being used to connect and match with the stop hook 8. Furthermore, a circle spring 9 is provided outside the casing plug 7 for fixing the stop hook 8.

The first position 71 and the second position 72 are provided in different heights of the surface of the sliding shaft 2 and matched with the stop hook 8, wherein the first position 71 is nearer to the head 21 of the sliding shaft 2 than the second position 72. The sliding shaft 2 has a first unidirectional sliding slot in the surface thereof for guiding the sliding shaft 2 matched with the hook member of the stop hook 8 to move from the first position 71 to the second position 72, and a second unidirectional sliding slot in the surface thereof for guiding the sliding shaft 2 matched with the hook member of the stop hook 8 to move from the second position 72 to the first position 71. The first unidirectional sliding slot comprises a first sliding segment 81 which starts from the first position 71, and a second sliding segment 82 which is connected with the first sliding segment 81 and extended to the second position 72, wherein a first joint 91 of the first sliding segment 81 and the second sliding segment 82 is farther to the head 21 of the sliding shaft 2 than the second position 72. Similarly, the second unidirectional sliding slot comprises a third sliding segment 83 which starts from the second position 72, and a fourth sliding segment 84 which is connected with the third sliding segment 83, wherein a second joint 92 of the third sliding segment 83 and the fourth sliding segment 84 is farther to the head 21 of the sliding shaft 2 than the second position 72. The fourth sliding segment 84 is communicated to the first sliding segment 81, or connected with the first position 71.

To achieve the unidirectional relative movement between the sliding slots and the stop hook 8, there are two ways: by designing the sidewalls of the sliding slots or by designing the bottom of the sliding slots. The first embodiment applies to designing the bottom of the sliding slots to achieve above purpose, and to make the switch action reliable and long service life. The concrete implementation is that the first sliding segment 81 is connected with the second sliding segment 82 in a step-shaped manner, wherein at the first joint 91 of the first sliding segment 81 and the second sliding segment 82, the bottom of the second sliding segment 82 is lower than the first sliding segment 81. In the same way, the third sliding segment 83 is connected with the fourth sliding segment 84 in a step-shaped manner, wherein at the second joint 92 of the third sliding segment 83 and the fourth sliding segment 84, the bottom of the fourth sliding segment 84 is lower than the third sliding segment 83. The second sliding segment 82 has a downward stepped portion 93 at a position near to the second position 72. The fourth sliding segment 84 is connected with the first sliding segment 81 in a step-shaped manner, wherein at a third joint 94 of the fourth sliding segment 84 and the first sliding segment 81, the bottom of the first sliding segment 81 is lower than the fourth sliding segment 84.

In the first embodiment, the stop hook 8 which is capable of being moved in a certain range matches with the unrotatable sliding segments 81, 82, 83, 84 in the sliding shaft 2. Alternatively, a rotatable sliding shaft 2 may be used to be rotated in a certain range so as to achieve the relative movement between the sliding segments 81, 82, 83, 84 and the stop hook 8. However, the first embodiment is more comfortable and convenient.

Figure 2:
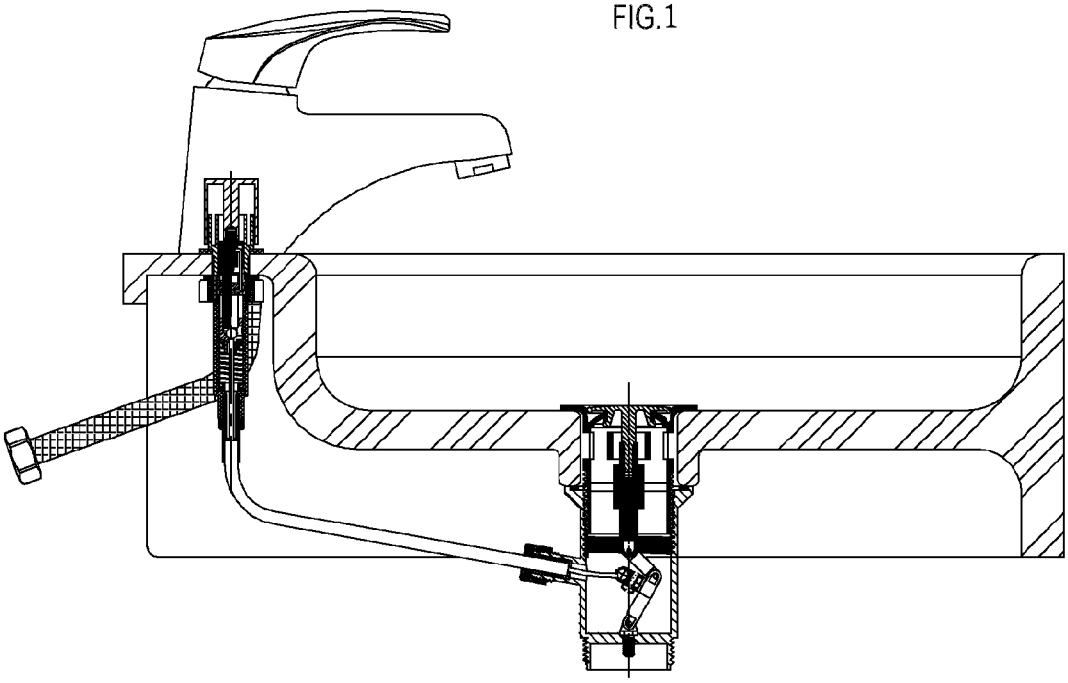
FIG. 2 is a sectional view taken along the line M-M shown in FIG. 5, illustrating storage state of the drainage device applied to a sink according to the first embodiment of the present invention.
Figure 5:
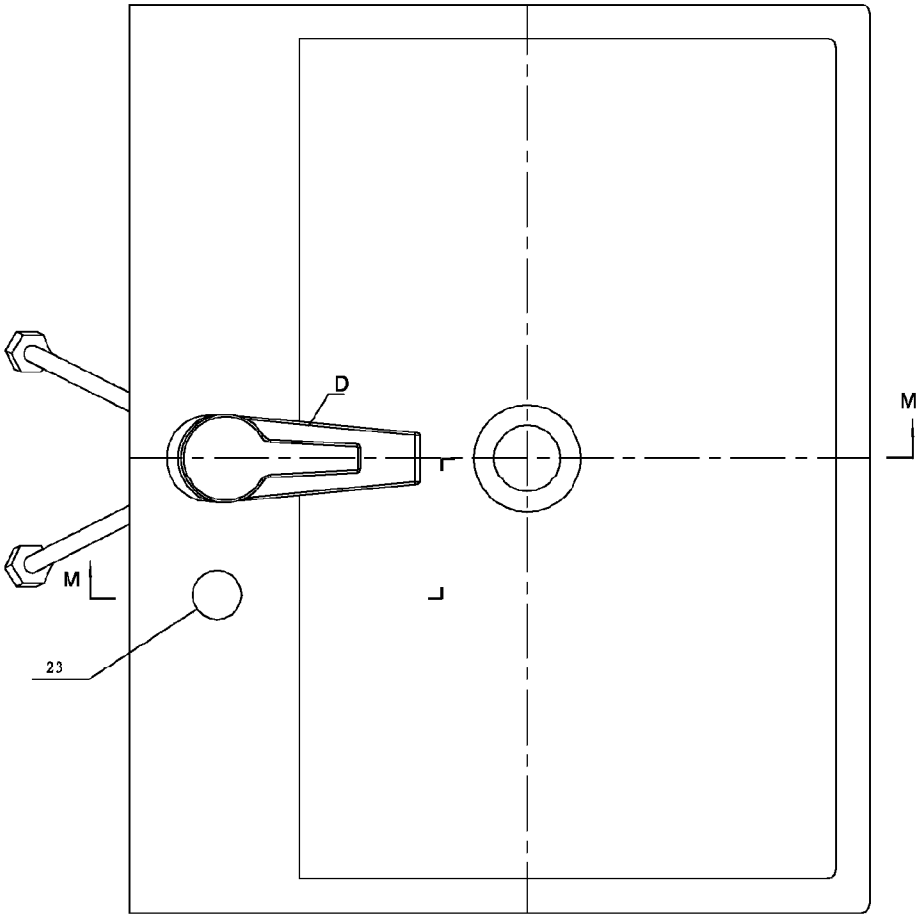
FIG. 5 is a top view of the drainage device according the first embodiment of the present invention.
Figure 4:
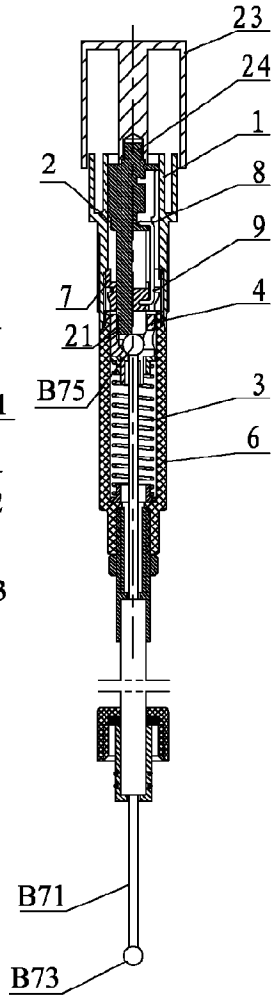
FIG. 4 is a sectional view of the operating mechanism according the first embodiment of the present invention.
Figure 3:
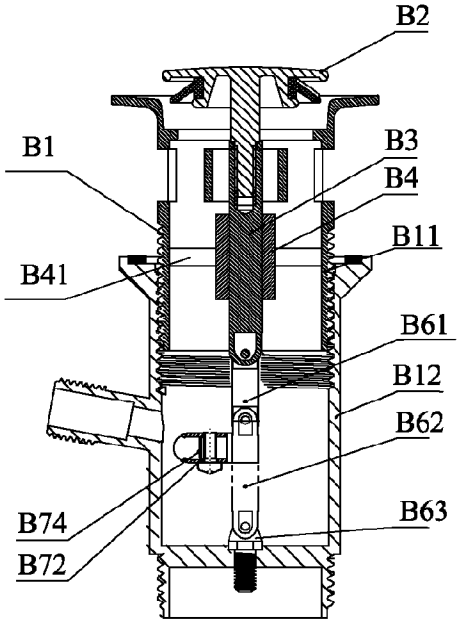
FIG. 3 is a sectional view of the drainage mechanism according the first embodiment of the present invention.
Figure 6:
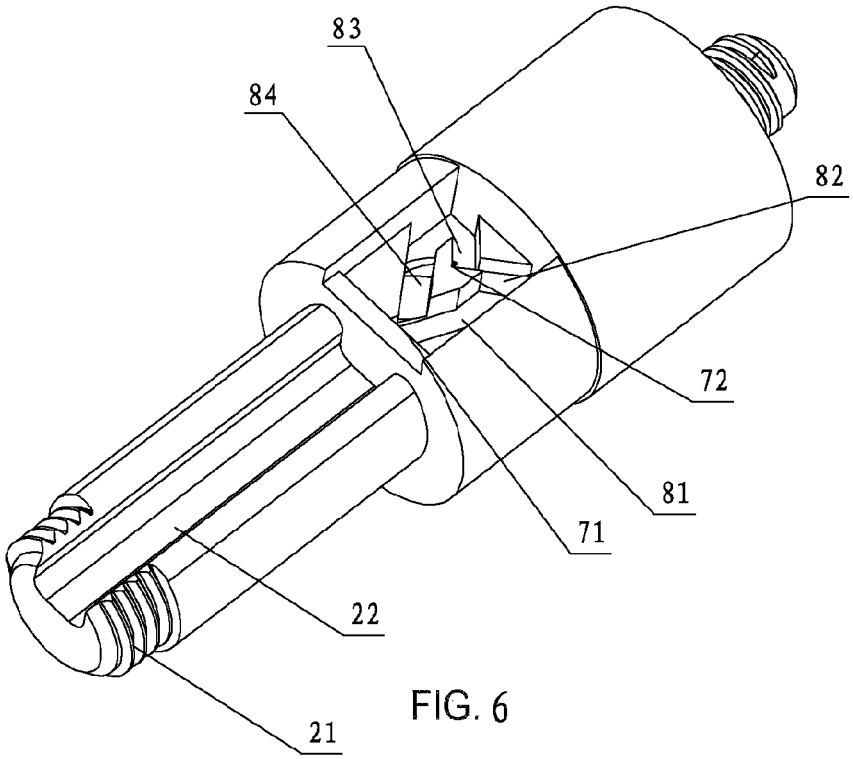
FIG. 6 is a schematic view of a sliding shaft of the operating mechanism as shown in FIG. 1.
Figure 7:
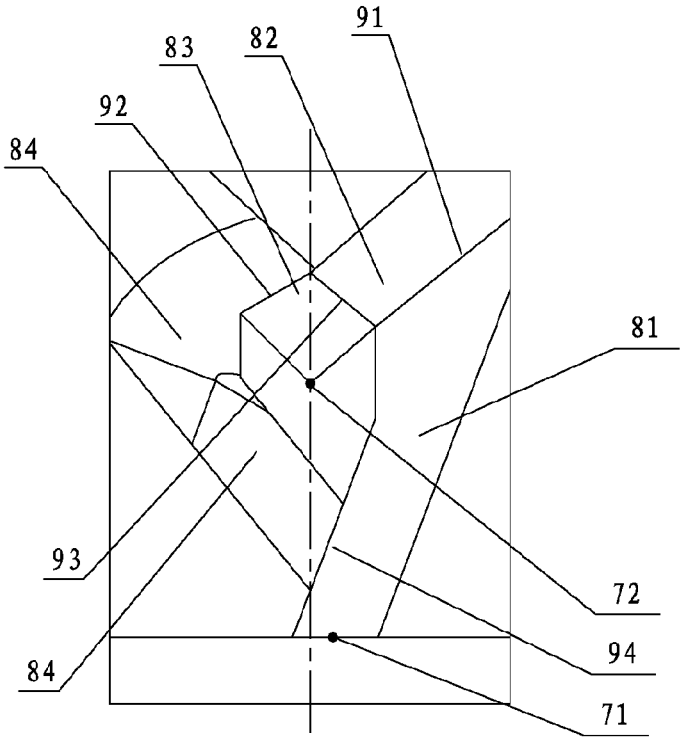
FIG. 7 is a schematic view of the sliding shaft positioning at unidirectional sliding slots and positions as shown in FIG. 6.
Figure 8:
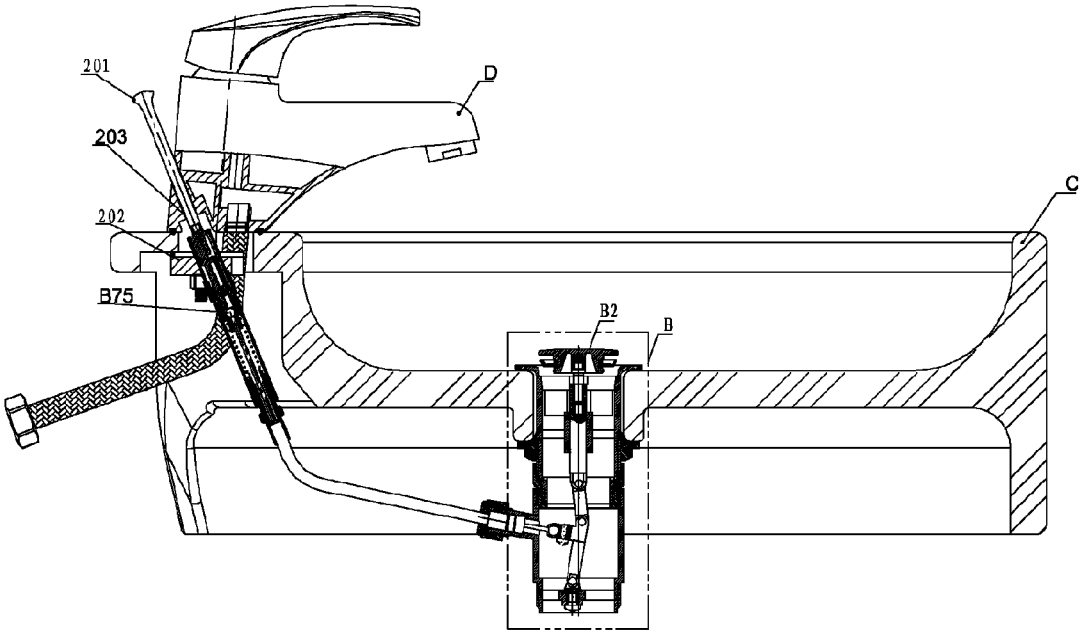
FIG. 8 is a sectional view of the drainage device applied to a sink according to the second embodiment of the present invention, illustrating the drainage state of the drainage device.
Figure 9:
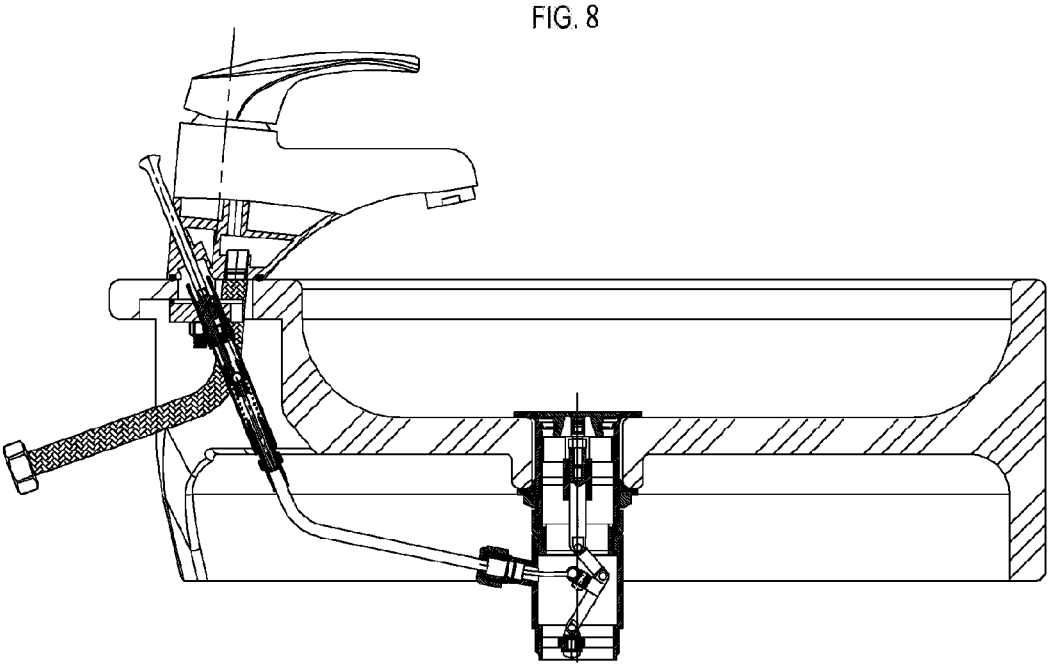
FIG. 9 is a sectional view of the drainage device applied to a sink according to the second embodiment of the present invention, illustrating the storage state of the drainage device.
Figure 11:
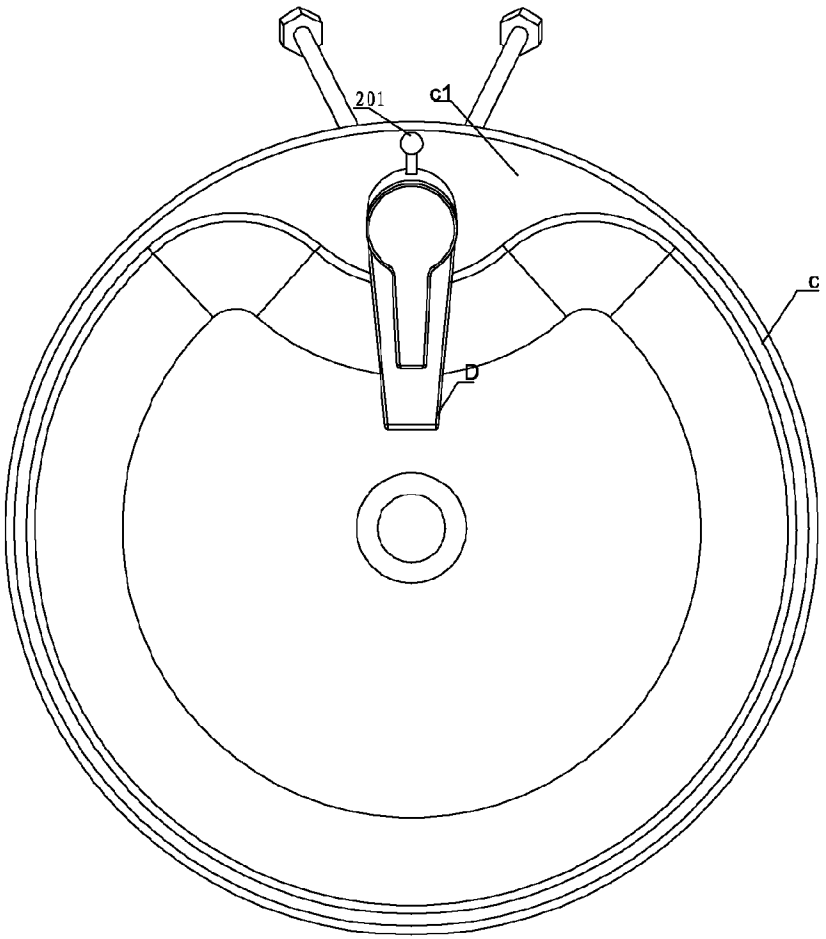
FIG. 11 is a top view according to the second embodiment of the present invention.
Figure 10:
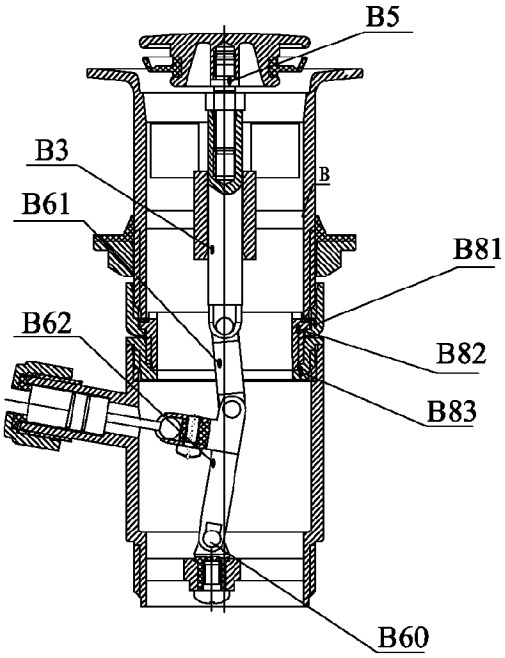
FIG. 10 is a sectional view of the drainage mechanism according the second embodiment of the present invention.

According to the first embodiment, the button 23 is used to control operation. To press the button 23 so as to move down the sliding shaft 2, then under the effect of the circle spring 9, the connecting member of the stop hook 8 is fixed at the casing plug 7, while the hook member of the stop hook 8 slides up from the first position 71 along the first sliding segment 81. Continue pressing the button 23, the hook member of the stop hook 8 passes through the first joint 91 and enters to the second sliding segment 82. When the button 23 is released, the sliding shaft 2 will move up under the effect of the spring 3. But owing to step-shaped connection between the first sliding segment 81 and the second sliding segment 82, and also because of the bottom of the second sliding segment 82 lower than the first sliding segment 81 at the first joint 91, the hook member of the stop hook 8 is not able to backtrack and only able to move down along the second sliding segment 82 to the area of the second position 72 and then to hook the second position 72 to complete a downward movement of the sliding shaft 2. This state is a first stop state of the operating mechanism A, in which the spring 3 is compressed, and under the effect of the coupling wire B71, the states of the linkage unit and the pipe cover B2 are as shown in FIG. 2. At this moment, the lower outlet of the sink C is closed by the pipe cover B2.

To press down the button 23 again, due to the second sliding segment 82 having a downward stepped portion 93 at a position near to the second position 72, the hook member of the stop hook 8 is not able to backtrack and only able to move up along the third sliding segment 83 and to enter the fourth sliding segment 84. When the button 23 is released, the sliding shaft 2 will move up under the effect of the spring 3. But owing to step-shaped connection between the third sliding segment 83 and the fourth sliding segment 84, and also because of the bottom of the fourth sliding segment 84 lower than the third sliding segment 83 at the second joint 92, the hook member of the stop hook 8 is not able to backtrack and only able to move down along the fourth sliding segment 84 to the first position 71 or along the fourth sliding segment 84 to enter the first sliding segment 81 and then reach the first position 71 and hook the first position 71, so as to complete a upward movement of the sliding shaft 2. This state is a second stop state of the operating mechanism A, in which the states of the linkage unit and the pipe cover B2 under the effect of the coupling wire B71 are as shown in FIG. 1. At this moment, the lower outlet of the sink C is open.

In an alternative operation, opening and closing the pipe cover B2 may be accomplished via reverse operation. Concretely, to press down the pipe cover B2, the linkage unit and the coupling wire B71 of the coupling member will take effect on the operating mechanism A, so as to make the button 23 or other operating rod move down. The operation for closing the pipe cover B2 is completed. In order to open the pipe cover B2, the button 23 or other operating rod is needed to be pressed down continually. Here, the sliding track of the sliding shaft 2 in this operation is same to that in the first embodiment.

Referring to FIG. 8 to FIG. 11 of the drawings, a second embodiment of a drainage device is illustrated, wherein the reference members shown in the FIG. 8 to FIG. 11 are same to and standing for identical meanings with those shown in the FIG. 1 to FIG. 7.

According to the second embodiment, the main body of the drainage mechanism B is identical to that in the first embodiment. The different point is that the upper pipe B11 is connected with the lower pipe B12 via threaded member. The threaded member comprises a nut B81, a threaded head B82, and an inner threaded connector B83, wherein a bolt B5 is provided at the upper end of the lifting rod B3, and the pipe cover B2 is threaded engaged with the bolt B5. In such a manner, the height of the pipe cover B2 is capable of being adjusted at a certain range so as to better cooperate with the bending and stretching movement of the linkage mechanism.

Furthermore, according to the second embodiment, the hinged joint B60 of the lower rocking rod B62 and the second frame B63 deviates from the centre of the downspout body B1 and is near to the side connected with the coupling member. In such a manner, the coupling member can be more convenient to push the lower rocking rod B62, so as to make the bending and stretching movement of the linkage unit smoother, which is benefit for fast opening and closing the pipe cover B2.

Compared with the first embodiment, the second embodiment provides a same operating mechanism A but adopts a different installation position. Furthermore, an operating rod 201 is adopted to replace the button 23.

The faucet D is connected with a press plate 202, and mounted on the sink C or a platform for supporting the sink C via the press plate 202. The press plate 202 has a threaded hole therein, and the fixing casing 1 of the operating mechanism A is threaded engaged with the threaded hole. The faucet D has a bias through hole 203 extended from the back thereof to the bottom thereof for passing the operating rod 201 therethrough.

The reference member C stands for sink.

Figure 12:
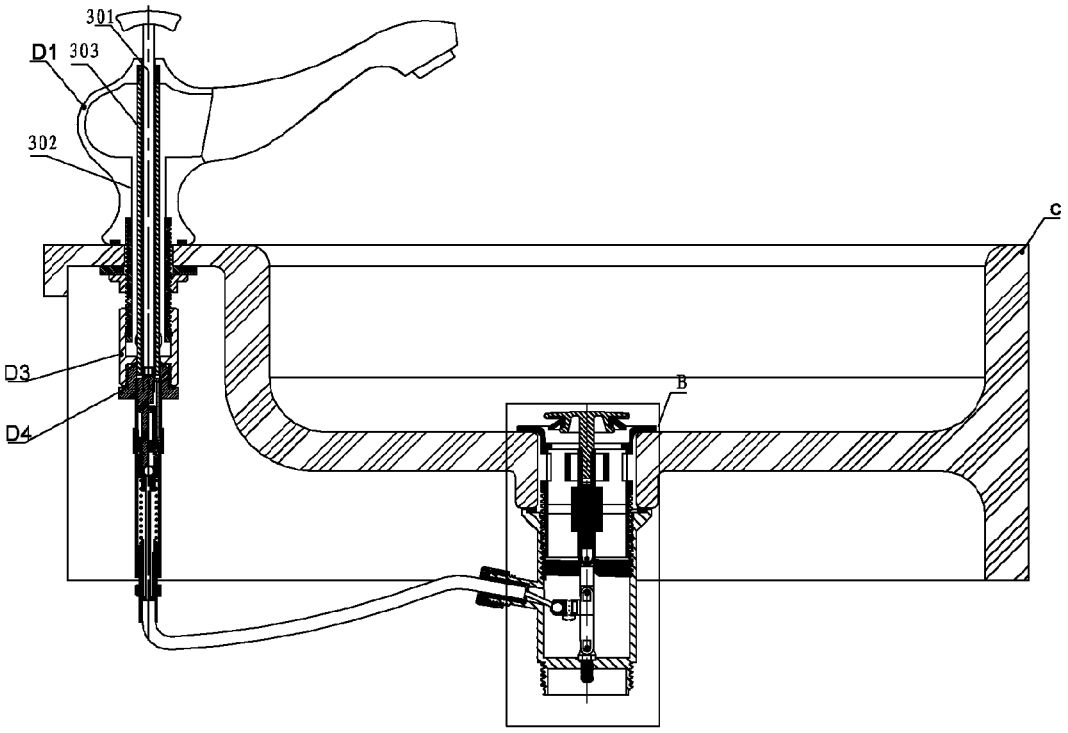
FIG. 12 is a sectional view of the drainage device applied to a sink according to the third embodiment of the present invention, illustrating the drainage state of the drainage device.
Figure 13:
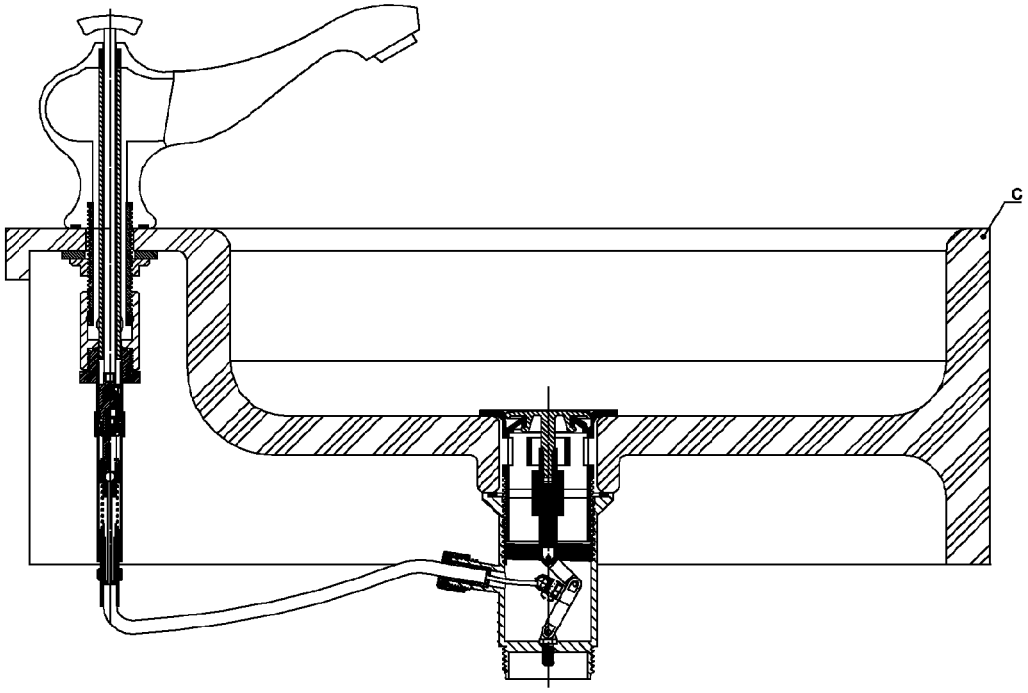
FIG. 13 is a sectional view of the drainage device applied to a sink according to the third embodiment of the present invention, illustrating the storage state of the drainage device.
Figure 14:
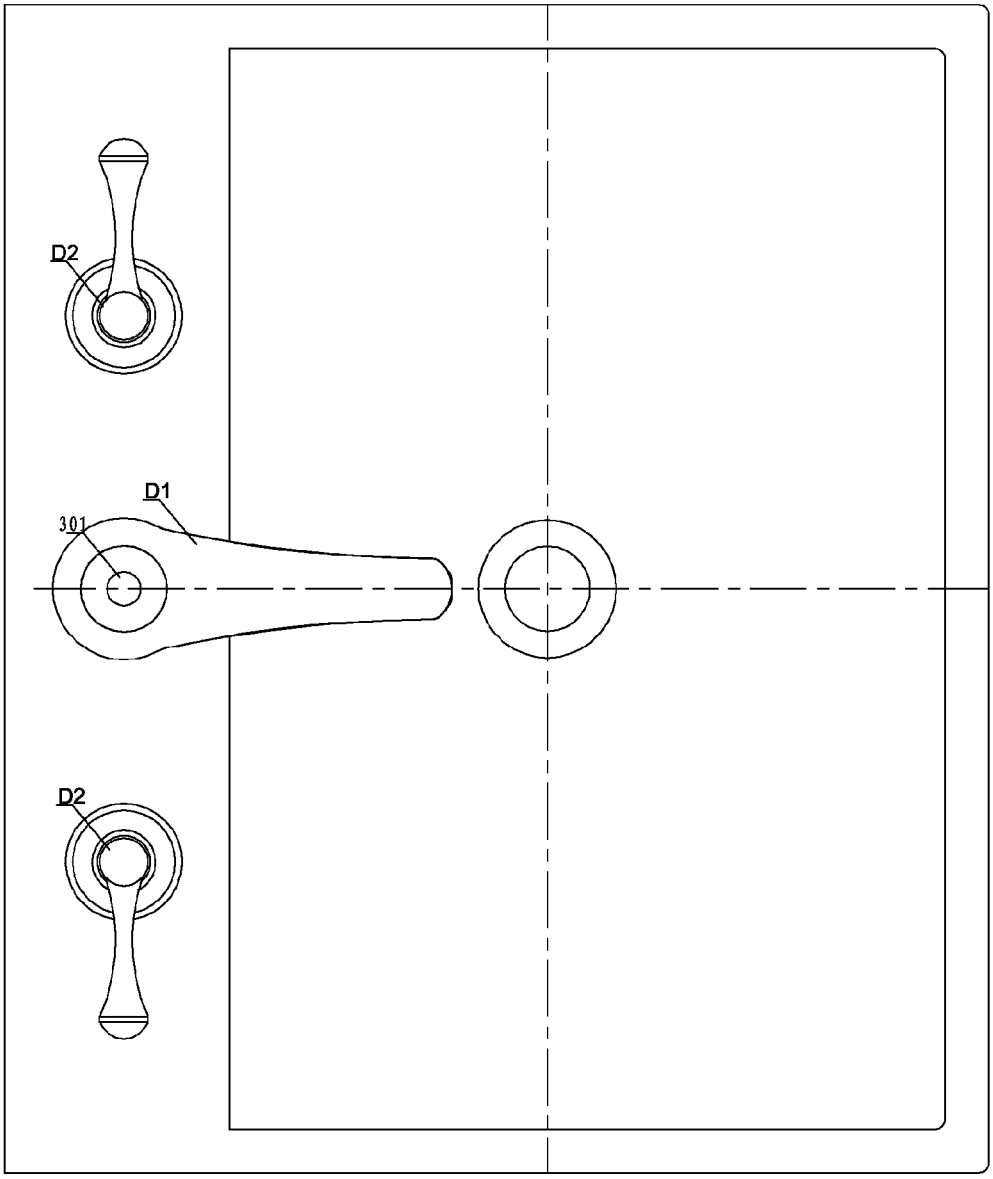
FIG. 14 is a top view according to the third embodiment of the present invention.

Referring to FIG. 12 to FIG. 14 of the drawings, a third embodiment of a drainage device is illustrated, in which a same operating mechanism A and a different installation position of the operating mechanism A are provided. And the drainage mechanism B is also as same as that in the first embodiment.

According to the first embodiment, the operating mechanism A is mounted on the sink C or a platform for supporting the sink C at a position beside the faucet D. The outer wall of the fixing casing 1 is step-shaped, and the fixing casing 1 is stuck and then fixed on the sink C or the platform by the nut 4. The other opponents of the operating mechanism A are all supported by the fixing casing 1.

The operating mechanism A comprises an operating rod 301 connected with the sliding shaft 2. Two handles D2 of the faucet D are separated from the outlet part D1 at a position outside the outlet part D1, wherein the handles D2 are communicated to the outlet part D1 via pipes. The operating mechanism A is vertically installed on a three-way connector D3 which is mounted on the inlet pipe underneath the outlet part D1, wherein the installation is completed via a nut adapter D4. Concretely, the nut adapter D4 connects the three-way connector D3 to the fixing casing 1. The outlet part D1 has a vertical hole 302 therein for passing the sliding shaft 2 and the operating rod 301 (or button) therethrough. Furthermore, on the section passing through the outlet pipe, the operating rod 301 is enclosed within an isolated sleeve 303.

The reference member C stands for sink.

Figure 15:
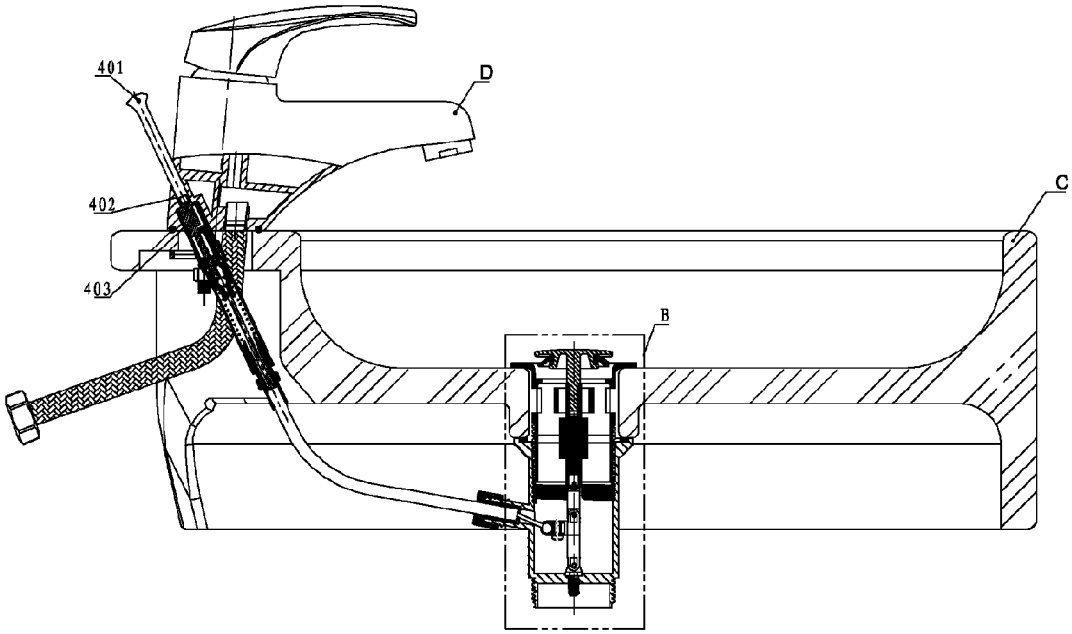
FIG. 15 is a sectional view of the drainage device applied to a sink according to the fourth embodiment of the present invention, illustrating the drainage state of the drainage device.
Figure 16:
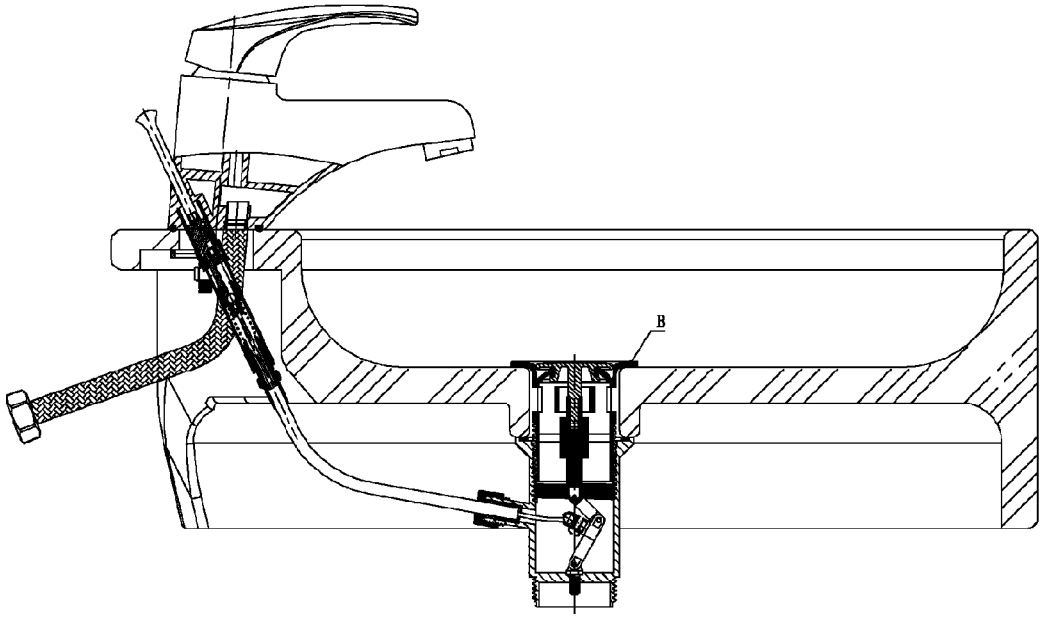
FIG. 16 is a sectional view of the drainage device applied to a sink according to the fourth embodiment of the present invention, illustrating the storage state of the drainage device.
Figure 17:
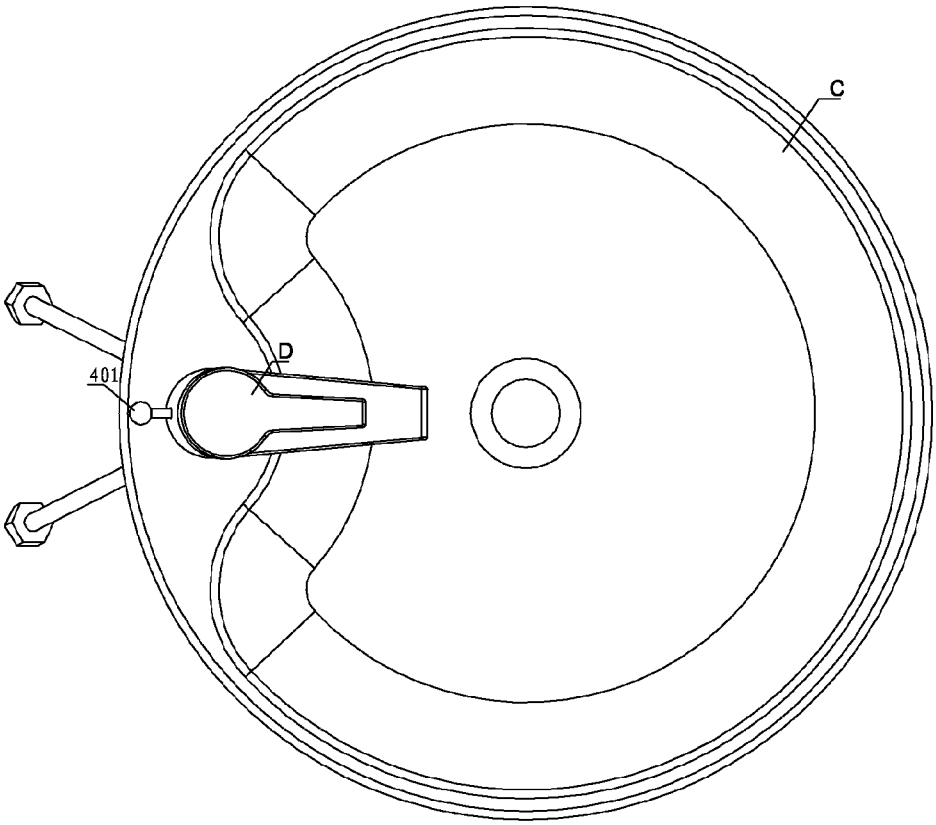
FIG. 17 is a top view according to the fourth embodiment of the present invention.

Referring to FIG. 15 to FIG. 17 of the drawings, a fourth embodiment of a drainage device is illustrated, in which a same operating mechanism A and a different installation position of the operating mechanism A are provided. In the fourth embodiment, part of components of the operating mechanism A are integrated into the faucet D, and the drainage mechanism B is also as same as that in the first embodiment.

The operating mechanism A comprises an operating rod 401 (or button) connected with the sliding shaft 2. The faucet D has a bias through hole 402 extended from the back thereof to the bottom thereof for passing the sliding shaft 2 and the operating rod 401 (or button) therethrough. The operating mechanism A is obliquely mounted on the faucet D. Concretely, the faucet D has a thread hole provided in the bottom thereof, and the fixing casing 1 of the operating mechanism A is threaded engaged with the threaded hole.

The reference member C stands for sink.

Figure 18:
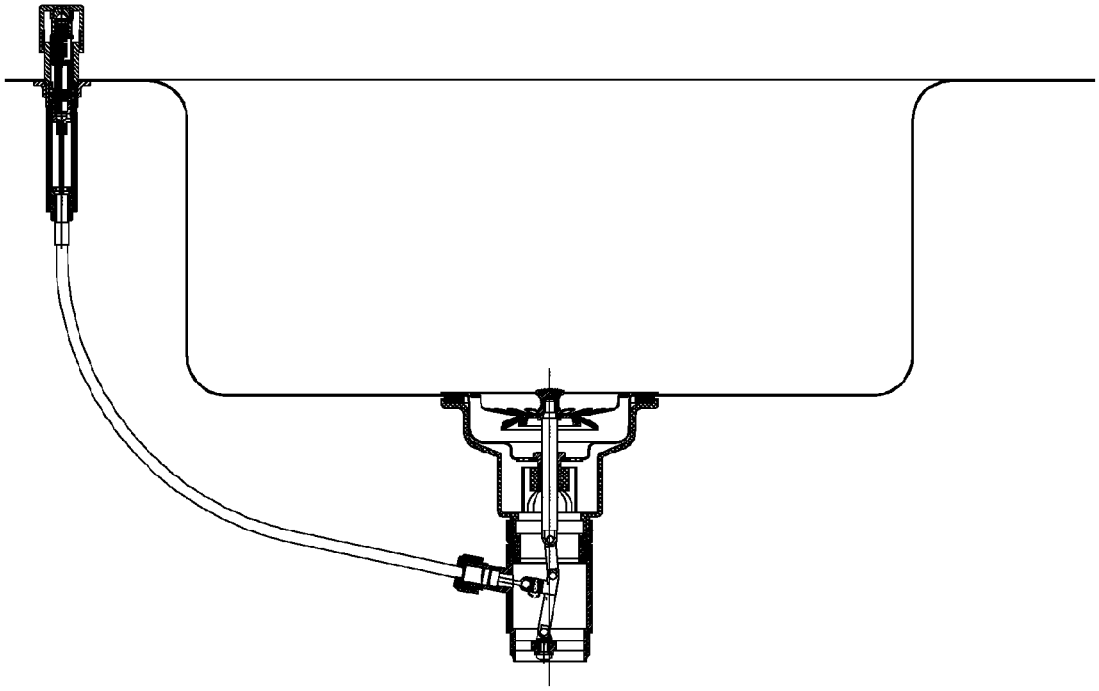
FIG. 18 is a sectional view of the drainage device applied to a bathtub according to the fifth embodiment of the present invention, illustrating the storage state of the drainage device.
Figure 19:
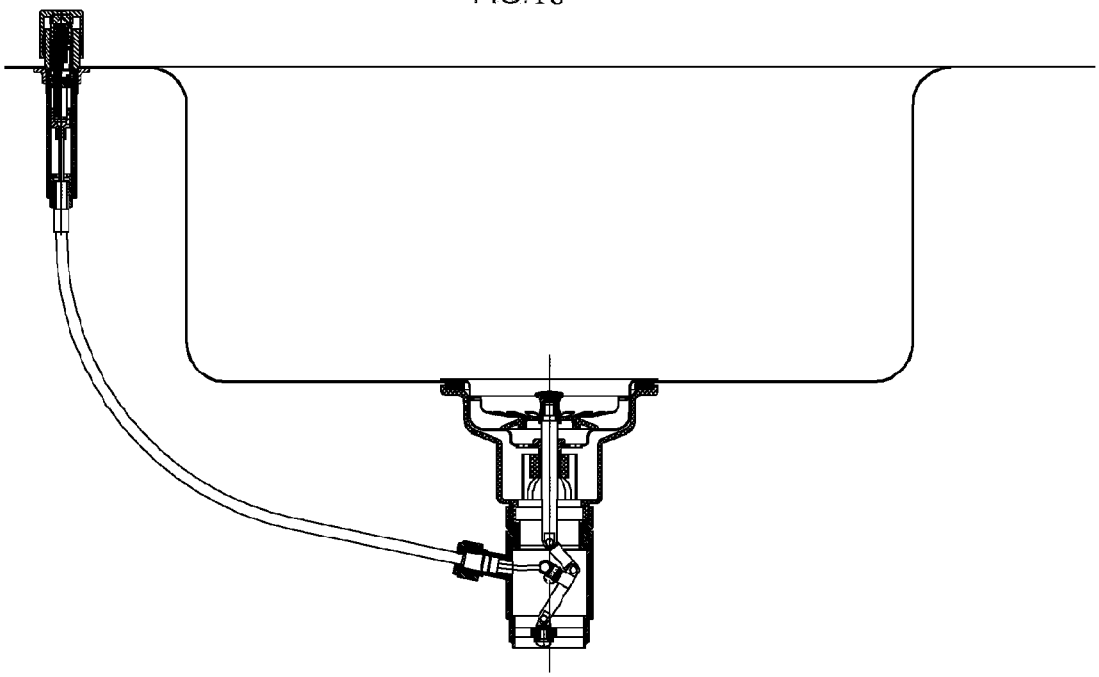
FIG. 19 is a sectional view of the drainage device applied to a sink according to the fifth embodiment of the present invention, illustrating the drainage state of the drainage device.

Referring to FIG. 18 to FIG. 19 of the drawings, a fifth embodiment of the drainage device applied to a bathtub is illustrated, in which different installation positions of the downspout B1 and the guide unit are provided. And the operating mechanism A and the drainage mechanism B are as same as those in the first embodiment.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A drainage device adapted to a basin in kitchen or bath comprising:

a drainage mechanism placed on a lower outlet of the basin, comprising:

a downspout body comprising an upper pipe and a lower pipe threaded engaged with the upper pipe, a rotatable linkage unit located in the lower pipe, which is capable of bending and stretching in a vertical direction, a guide unit located in the upper pipe for guiding vertical movement, and a pipe cover connected with an upper portion of the guide unit, an operating mechanism for controlling to open and close the pipe cover of the drainage mechanism, and a coupling member led from the sidewall of the downspout body, wherein one end of the coupling member is connected with the linkage unit, and the other end of the coupling member is connected with the operating mechanism, wherein the operating mechanism comprises:

a sliding shaft connected with the coupling member, having a head and a tail, a fixing casing with a hollow structure, wherein the sliding shaft is slidably located in the fixing casing, a spring mounted on the lower end of the fixing casing at a position to resist the sliding shaft from head to tail, and an operating member connected with the tail of the sliding shaft for controlling the sliding shaft, wherein the sliding shaft has a first position and a second position provided therein for keeping the sliding shaft stopping at different heights, wherein the first position is nearer to the head of the sliding shaft than the second position, wherein operating mechanism further comprises a stop hook having a hook member and a connecting member for fixing the stop hook, and the sliding shaft has a first unidirectional sliding slot in the surface thereof to guide the sliding shaft matched with the hook member of the stop hook to move from the first position to the second position, and a second unidirectional sliding slot in the surface thereof to guide the sliding shaft matched with the hook member of the stop hook to move from the second position to the first position, wherein the first unidirectional sliding slot comprises a first sliding segment starting from the first position, and a second sliding segment connected with the first sliding segment and extended to the second position, wherein a first joint of the first sliding segment and the second sliding segment is farther to the head of the sliding shaft than the second position, wherein the second unidirectional sliding slot comprises a third sliding segment starting from the second position, and a fourth sliding segment connected with the third sliding segment, wherein a second joint of the third sliding segment and the fourth sliding segment is farther to the head of the sliding shaft than the second position, wherein the fourth sliding segment is communicated to the first sliding segment, or connected with the first position.

2. A drainage device adapted to a basin in kitchen or bath comprising:

a drainage mechanism placed on a lower outlet of the basin, comprising:

a downspout body comprising an upper pipe and a lower pipe threaded engaged with the upper pipe, a rotatable linkage unit located in the lower pipe, which is capable of bending and stretching in a vertical direction, a guide unit located in the upper pipe for guiding vertical movement, and a pipe cover connected with an upper portion of the guide unit, an operating mechanism for controlling to open and close the pipe cover of the drainage mechanism, and a coupling member led from the sidewall of the downspout body, wherein one end of the coupling member is connected with the linkage unit, and the other end of the coupling member is connected with the operating mechanism, wherein the operating mechanism comprises:

a sliding shaft connected with the coupling member, having a head and a tail, a fixing casing with a hollow structure, wherein the sliding shaft is slidably located in the fixing casing, a spring mounted on the lower end of the fixing casing at a position to resist the sliding shaft from head to tail, and an operating member connected with the tail of the sliding shaft for controlling the sliding shaft, wherein the sliding shaft has a first position and a second position provided therein for keeping the sliding shaft stopping at different heights, wherein the first position is nearer to the head of the sliding shaft than the second position, wherein the guide unit comprises a guide pipe connected with the upper pipe of the downspout body, wherein the linkage unit comprises a lifting rod passing through the guide pipe and having an upper end connected with the pipe cover, a middle linking rod having an upper end hingedly connected with a lower end of the lifting rod, and a lower rocking rod connected with the coupling member, having an upper end hingedly connected with a lower end of the middle linking rod, and a lower end hingedly fixed on the bottom of the lower pipe, wherein the coupling member comprises a coupling wire, a first coupling ball is provided on one end of the coupling wire, a coupling base connected with the lower rocking rod, wherein the first coupling ball is rotatably stuck in the coupling base, and a block connected with the coupling base and matched with the coupling ball to push and resist the first coupling ball, wherein the coupling member further comprises a second coupling ball provided on the other end of the coupling wire, and the head of the sliding shaft is threaded engaged with a nut, wherein the second coupling ball is stuck in the nut, wherein operating mechanism further comprises a stop hook having a hook member and a connecting member for fixing the stop hook, and the sliding shaft has a first unidirectional sliding slot in the surface thereof to guide the sliding shaft matched with the hook member of the stop hook to move from the first position to the second position, and a second unidirectional sliding slot in the surface thereof to guide the sliding shaft matched with the hook member of the stop hook to move from the second position to the first position, wherein the first unidirectional sliding slot comprises a first sliding segment starting from the first position, and a second sliding segment connected with the first sliding segment and extended to the second position, wherein a first joint of the first sliding segment and the second sliding segment is farther to the head of the sliding shaft than the second position, wherein the second unidirectional sliding slot comprises a third sliding segment starting from the second position, and a fourth sliding segment connected with the third sliding segment, wherein a second joint of the third sliding segment and the fourth sliding segment is farther to the head of the sliding shaft than the second position, wherein the fourth sliding segment is communicated to the first sliding segment, or connected with the first position.

3. The drainage device, as recited in claim 1, wherein the first sliding segment is connected with the second sliding segment in a step-shaped manner, and at the first joint the bottom of the second sliding segment is lower than the first sliding segment, wherein the third sliding segment is connected with the fourth sliding segment in a step-shaped manner, and at the second joint, the bottom of the fourth sliding segment is lower than the third sliding segment, wherein the second sliding segment has a downward stepped portion at a position near to the second position, and the fourth sliding segment is connected with the first sliding segment in a step-shaped manner, wherein at a third joint, the bottom of the first sliding segment is lower than the fourth sliding segment.

4. The drainage device, as recited in claim 2, wherein the first sliding segment is connected with the second sliding segment in a step-shaped manner, and at the first joint the bottom of the second sliding segment is lower than the first sliding segment, wherein the third sliding segment is connected with the fourth sliding segment in a step-shaped manner, and at the second joint, the bottom of the fourth sliding segment is lower than the third sliding segment, wherein the second sliding segment has a downward stepped portion at a position near to the second position, and the fourth sliding segment is connected with the first sliding segment in a step-shaped manner, wherein at a third joint, the bottom of the first sliding segment is lower than the fourth sliding segment.

5. The drainage device, as recited in claim 4, wherein the lower end of the lower rocking rod is hingedly fixed on the bottom of the lower pipe at a position deviating from the center of the downspout body and near to a side connected with the coupling member.

* * * * *